US011229302B2

(12) United States Patent
Ciesick

(10) Patent No.: US 11,229,302 B2
(45) Date of Patent: Jan. 25, 2022

(54) ROLLER RACK ASSEMBLY

(71) Applicant: James Ciesick, Cincinnati, OH (US)

(72) Inventor: James Ciesick, Cincinnati, OH (US)

( * ) Notice: Subject to any disclaimer, the term of this patent is extended or adjusted under 35 U.S.C. 154(b) by 0 days.

(21) Appl. No.: 17/005,577

(22) Filed: Aug. 28, 2020

(65) Prior Publication Data

US 2021/0059434 A1 Mar. 4, 2021

Related U.S. Application Data

(60) Provisional application No. 62/893,523, filed on Aug. 29, 2019.

(51) Int. Cl.

| | |
|---|---|
| ***A47F 5/00*** | (2006.01) |
| ***A47F 1/12*** | (2006.01) |
| ***A47B 57/04*** | (2006.01) |
| ***A47B 57/58*** | (2006.01) |
| ***A47F 5/08*** | (2006.01) |
| ***A47B 47/02*** | (2006.01) |
| ***A47B 96/02*** | (2006.01) |

(52) U.S. Cl.

CPC ..... *A47F 5/0018* (2013.01); *A47B 47/022* (2013.01); *A47B 57/045* (2013.01); *A47B 57/585* (2013.01); *A47B 96/027* (2013.01); *A47F 1/126* (2013.01); *A47F 5/0043* (2013.01); *A47F 5/0087* (2013.01); *A47F 5/08* (2013.01)

(58) Field of Classification Search

CPC .... A47F 5/0018; A47F 5/0013; A47F 5/0087; A47F 1/126; A47F 1/125; A47F 1/12; A47F 5/08; A47F 5/005; A47F 7/144; A47B 57/583; A47B 57/585; A47B 96/04; A47B 57/045; A47B 57/00; A47B 96/027; A47B 47/022; A47B 57/581

USPC ..... 211/59.3, 162, 151, 193, 87.01, 184; 193/35 R; 221/226, 227, 270

See application file for complete search history.

(56) References Cited

U.S. PATENT DOCUMENTS

| | | | |
|---|---|---|---|
| 2,891,677 | A | 6/1959 | Ritchie |
| 2,964,154 | A | 12/1960 | Erickson |
| 3,780,876 | A | 12/1973 | Elkins |
| 3,872,976 | A | 3/1975 | Moore et al. |

(Continued)

FOREIGN PATENT DOCUMENTS

| | | | |
|---|---|---|---|
| AU | 2010202643 | A1 | 1/2011 |
| CN | 102368931 | B | 12/2013 |

(Continued)

*Primary Examiner* — Jennifer E. Novosad

(74) *Attorney, Agent, or Firm* — Faegre Drinker Biddle & Reath LLP

(57) ABSTRACT

A roller rack assembly for storing and displaying one or more products, the roller rack assembly including a support tray and a roller track assembly disposed on the support tray. The roller track assembly includes at least one roller track, a front end cap attached to a front end of the roller track, and a rear end cap attached to a rear end of the roller track. A plurality of cylindrical rollers are mounted to the roller track and arranged parallel to one another, with lateral sides perpendicular to a rotational axis. Each roller has an axle extending out of each lateral side. Each axle is mounted to a side wall of the roller track. A pusher mechanism is provided that includes a pusher back located above the roller track and a spring mechanism biasing the pusher back toward the front end of the roller track.

19 Claims, 10 Drawing Sheets

(56) References Cited

U.S. PATENT DOCUMENTS 4,476,985 A 10/1984 Norberg et al.
4,615,276 A 10/1986 Garabedian
4,685,574 A 8/1987 Young et al.
4,750,743 A * 6/1988 Nicoletti ..... A63F 1/14 273/148 A
4,762,236 A 8/1988 Jackie, III et al.
5,115,920 A 5/1992 Tipton et al.
5,190,186 A 3/1993 Yablans et al.
5,390,802 A * 2/1995 Pappagallo ..... A47B 45/00 211/187
5,437,116 A 8/1995 Hardy
5,474,412 A 12/1995 Pfeiffer et al.
5,505,315 A 4/1996 Carroll
5,788,090 A 8/1998 Kajiwara
5,803,276 A 9/1998 Vogler
5,855,283 A * 1/1999 Johnson ..... A47F 1/126 211/59.3
5,970,887 A 10/1999 Hardy
5,971,173 A 10/1999 Valiulis et al.
6,041,720 A 3/2000 Hardy
6,047,647 A 4/2000 Laraia, Jr.
6,082,557 A 7/2000 Leahy
6,089,385 A 7/2000 Nozawa
6,102,185 A 8/2000 Neuwirth et al.
6,129,218 A 10/2000 Henry et al.
6,132,158 A 10/2000 Pfeiffer et al.
6,142,317 A * 11/2000 Merl ..... A47F 1/125 211/184
6,305,559 B1 10/2001 Hardy
6,311,852 B1 11/2001 Ireland
6,409,026 B2 6/2002 Watanabe
6,431,808 B1 8/2002 Lowrey et al.
6,490,983 B1 12/2002 Nicholson et al.
6,497,326 B1 * 12/2002 Osawa ..... A47F 7/28 211/59.2
6,533,131 B2 3/2003 Bada
6,719,152 B1 * 4/2004 Nagel ..... A47F 1/126 211/59.3
RE38,517 E 5/2004 Pfeiffer et al.
6,820,754 B2 * 11/2004 Ondrasik ..... A47F 1/126 211/59.3
6,830,146 B1 12/2004 Scully et al.
6,866,155 B2 * 3/2005 Nagel ..... A47F 1/126 211/59.3
7,093,546 B2 8/2006 Hardy
7,114,606 B2 10/2006 Shaw et al.
7,124,897 B2 10/2006 Bustos
7,150,365 B2 12/2006 Hardy et al.
7,152,536 B2 12/2006 Hardy
7,216,770 B2 5/2007 Mueller et al.
7,299,934 B2 11/2007 Hardy et al.
7,389,886 B2 6/2008 Hardy et al.
7,395,938 B2 7/2008 Merit et al.
7,451,881 B2 11/2008 Hardy et al.
7,497,341 B2 3/2009 Hardy et al.
7,497,342 B2 * 3/2009 Hardy ..... A47F 1/126 211/151
7,621,409 B2 11/2009 Hardy et al.
7,628,282 B2 * 12/2009 Hardy ..... A47F 1/126 211/151
7,635,068 B2 12/2009 Hardy
7,661,545 B2 2/2010 Hardy et al.
7,681,744 B2 * 3/2010 Johnson ..... A47F 1/126 211/59.3
7,784,623 B2 8/2010 Mueller et al.
7,823,734 B2 11/2010 Hardy
7,891,503 B2 2/2011 Hardy
7,922,010 B2 * 4/2011 Hardy ..... A47F 1/126 211/59.3
7,971,735 B2 7/2011 Mueller et al.
8,016,139 B2 * 9/2011 Hanners ..... A47F 5/005 211/184
8,025,162 B2 * 9/2011 Hardy ..... A47F 1/126 211/59.3
8,047,385 B2 11/2011 Hardy
8,113,360 B2 2/2012 Olson
8,113,601 B2 2/2012 Hardy
8,172,094 B2 5/2012 Meyer et al.
8,235,227 B2 8/2012 Hardy
8,251,232 B2 8/2012 Nakaya et al.
8,276,772 B2 10/2012 Kim
8,312,999 B2 11/2012 Hardy
8,322,544 B2 12/2012 Hardy
8,365,950 B2 * 2/2013 Yuyama ..... G07F 11/42 221/123
8,376,154 B2 * 2/2013 Sun ..... A47F 1/125 211/151
8,413,823 B2 4/2013 Hardy
8,453,850 B2 6/2013 Hardy
8,453,851 B2 * 6/2013 Ciesick ..... A47F 1/126 211/59.3
8,573,379 B2 11/2013 Brugmann
8,579,123 B2 11/2013 Mueller et al.
8,596,443 B2 12/2013 Brugmann
8,657,132 B2 2/2014 Benz et al.
8,662,325 B2 3/2014 Davis et al.
8,720,702 B2 * 5/2014 Nagel ..... A47F 1/128 211/59.3
8,739,984 B2 6/2014 Hardy
8,746,468 B2 6/2014 Poulokefalos
8,919,580 B2 12/2014 Johnson et al.
8,978,903 B2 3/2015 Hardy
8,978,904 B2 3/2015 Hardy
9,016,482 B2 4/2015 Kim
9,016,483 B2 4/2015 Howley
9,038,804 B1 5/2015 Nickell
9,038,833 B2 5/2015 Ciesick
9,060,624 B2 6/2015 Hardy
9,101,230 B2 * 8/2015 Sosso ..... A47F 5/0018
9,138,075 B2 9/2015 Hardy et al.
9,138,076 B2 * 9/2015 Hardy ..... A47F 5/005
9,149,132 B2 10/2015 Hardy
9,167,913 B2 10/2015 Hardy
9,173,504 B2 11/2015 Hardy
9,220,353 B2 12/2015 Brugmann
9,254,049 B2 * 2/2016 Nagel ..... A47F 1/04
9,265,358 B2 2/2016 Hardy
9,265,362 B2 2/2016 Hardy
9,266,678 B2 2/2016 Nickell
9,289,078 B2 3/2016 Hardy
9,320,367 B2 4/2016 Chambers
9,357,841 B2 6/2016 Obitts et al.
9,375,098 B2 6/2016 Sun
9,392,884 B2 * 7/2016 Juric ..... A47F 1/126
9,415,944 B2 8/2016 Sozio et al.
9,504,321 B2 11/2016 Hardy
9,526,351 B2 12/2016 Hardy
9,538,860 B2 1/2017 Brej et al.
9,549,622 B2 1/2017 Leahy et al.
9,668,590 B1 6/2017 Bruegmann
9,687,085 B2 6/2017 Hardy
9,713,394 B1 * 7/2017 Bruegmann ..... A47F 5/0025
9,723,934 B2 8/2017 Hardy
9,730,531 B2 8/2017 Hardy
9,770,121 B2 9/2017 Walker et al.
9,820,585 B2 11/2017 Hardy et al.
9,861,211 B2 1/2018 Miller, Jr. et al.
10,034,557 B1 * 7/2018 Nagel ..... A47F 1/126
10,251,494 B1 * 4/2019 Nagel ..... A47F 5/005
10,786,094 B2 * 9/2020 Bruegmann ..... A47F 5/005
2002/0148794 A1 * 10/2002 Marihugh ..... A47F 1/126 211/59.3
2004/0178156 A1 9/2004 Knorring et al.
2004/0245197 A1 * 12/2004 McElvaney ..... A47F 1/126 211/184
2005/0139560 A1 6/2005 Whiteside et al.
2005/0150847 A1 7/2005 Hawkinson
2006/0076301 A1 4/2006 Caterinacci et al.
2006/0108306 A1 5/2006 Minchey
2006/0163272 A1 * 7/2006 Gamble ..... A47F 1/126 221/227

(56) References Cited

U.S. PATENT DOCUMENTS

| | | | | |
|---|---|---|---|---|
| 2006/0237381 | A1* | 10/2006 | Lockwood | A47F 1/126 211/59.3 |
| 2007/0068885 | A1* | 3/2007 | Busto | A47F 1/125 211/59.3 |
| 2007/0256992 | A1 | 11/2007 | Olson | |
| 2010/0072152 | A1 | 3/2010 | Kim | |
| 2010/0133214 | A1 | 6/2010 | Evans | |
| 2010/0206829 | A1 | 8/2010 | Clements et al. | |
| 2011/0017684 | A1* | 1/2011 | Nagel | A47F 1/126 211/59.3 |
| 2011/0180498 | A1 | 7/2011 | Kidd et al. | |
| 2011/0204012 | A1 | 8/2011 | Eguchi et al. | |
| 2012/0217212 | A1 | 8/2012 | Czalkiewicz et al. | |
| 2012/0255924 | A1* | 10/2012 | Kologe | A47F 5/0025 211/126.15 |
| 2013/0031815 | A1 | 2/2013 | Hardy | |
| 2013/0075352 | A1 | 3/2013 | Mitten et al. | |
| 2014/0305894 | A1 | 10/2014 | Thompson | |
| 2015/0053633 | A1 | 2/2015 | McDonnell | |
| 2015/0129521 | A1* | 5/2015 | Sun | A47F 1/125 211/59.3 |
| 2016/0081491 | A1 | 3/2016 | Hardy | |
| 2016/0296039 | A1 | 10/2016 | Bird et al. | |
| 2017/0035218 | A1 | 2/2017 | Riley et al. | |
| 2017/0280894 | A1 | 10/2017 | Kim et al. | |
| 2021/0059434 | A1* | 3/2021 | Ciesick | A47F 5/0018 |

FOREIGN PATENT DOCUMENTS

| | | | |
|---|---|---|---|
| DE | 4433859 | A1 | 3/1996 |
| DE | 202004019588 | U1 | 6/2005 |
| EP | 1110880 | B1 | 5/2004 |
| EP | 2159169 | A1 | 3/2010 |
| EP | 2181945 | B1 | 9/2011 |
| EP | 2944228 | A1 | 11/2015 |
| EP | 2764800 | B1 | 8/2016 |
| FR | 2942590 | A1 | 9/2010 |
| KR | 100828966 | B1 | 5/2008 |
| KR | 2016094454 | A | 8/2016 |
| KR | 2017053498 | A | 5/2017 |
| WO | 9963864 | A1 | 12/1999 |
| WO | 2006028245 | A1 | 3/2006 |
| WO | 2006028246 | A1 | 3/2006 |
| WO | 2009151381 | A1 | 12/2009 |
| WO | 2010126388 | A1 | 11/2010 |

* cited by examiner

ROLLER RACK ASSEMBLY

RELATED APPLICATION

This application is related to and claims priority from U.S. Provisional Application No. 62/893,523, filed on Aug. 29, 2019, the disclosure of which is incorporated herein by reference in its entirety.

FIELD OF THE INVENTION

The present invention related to display systems for mounting to shelving in order to display multiple products for consumers to purchase and, more particularly, to an improved roller shelf system.

BACKGROUND

It is common is display systems to arrange consumable products, such as packaged boxes or bottles, in rows across a shelf. However as each consumable product is removed, the product behind it remains in place spaced from the edge of the shelf. As more and more products are removed, the next available products is further and further away from the consumer.

In recent years, roller shelves have been installed on or in replace of standard flat shelves. Those shelves include a series of rollers that permit products in a row to roll to the front of the assembly. One conventional type roller assembly includes a spring-pusher system that urges the products along the rollers to the front of the assembly. When an item within a row is removed, the spring-pusher applies pressure to the last product in the row urging the entire line of remaining products forward.

Another type of roller assembly, sometimes referred to as a gravity-based system, involves angling the rollers downward slightly toward the front of the display. Those systems utilize gravity to cause remaining products on the roller assembly to roll forward when a product is removed.

A need exists for an improved roller assembly that provides for ease of assembly.

SUMMARY OF THE INVENTION

A roller rack assembly for storing and displaying one or more products is disclosed. In one embodiment, the roller rack assembly includes a support tray, and a roller track assembly on the support tray. The roller track assembly includes at least one roller track with a front end, a rear end, a bottom and two spaced apart side walls. A front end cap is attached to the front end of the roller track. A rear end cap is attached to the rear end of the roller track. A plurality of rollers are mounted to the roller track and arranged parallel to one another. Each roller has a substantially cylindrical roller surface with a rotational axis, and lateral sides perpendicular to the rotational axis. Each roller also has an axle extending out of each lateral side with an axis coincident with the rotational axis. Each axle is rotationally mounted to a side wall of the roller track so that the roller can rotate about its axles. A pusher mechanism including a pusher back located above the roller track and a spring mechanism biasing the pusher back toward the front end of the roller track for urging products in front of the pusher back to slide on the rollers toward the front end of the roller track.

Preferably the front end cap includes a slot that extends substantially across the end cap. The slot is configured to receive a display panel which stops or inhibits forward motion of products that are on the rollers.

In one embodiment, the roller rack assembly optionally includes a plurality of hooks mounted on the back of the support tray for securing the support tray to a structure.

Preferably the roller assembly includes one or more lateral supports that slidably attach to the roller track assembly or the support tray and are configured to be laterally translatable relative to the roller track assembly.

In one configuration, the roller track assembly includes at least two roller tracks.

Preferably the pusher back includes a pusher foot that is sized to slide within a groove in the roller track assembly located between the two roller tracks.

In one embodiment, the spring mechanism includes a torsion spring with a first end secured to the front end cap and a second end mounted to the pusher back or the pusher foot.

Preferably the bottom and side walls of the roller track define a U-shape and the front end cap and rear end cap each include laterally spaced apart sides and a base that are shaped to engage with the sides and bottom of the roller track so that the front and rear end caps are each captured within and secured to the roller track.

In an embodiment, the roller track includes a base track and a roller frame that is slidably mounted within the base track.

The roller frame may include two spaced apart frame walls, with each frame wall having a plurality of equally spaced apart holes formed in the frame wall. One of the axles of each roller is located in one of the holes in one of the frame walls and the other axle of the roller is located in another hole in the other of the frame walls. The holes are configured to permit the roller to rotate within the holes.

In one configuration the roller frame is formed with weakened points along its length that facilitate the breaking of the roller frame at those discrete locations to divide the roller frame into smaller segments.

In an embodiment, a support frame is attached to the bottom of the roller track assembly, the support frame includes brackets that attach to the bottom of the front end cap and rear end cap and longitudinal beams that are attached to the brackets for providing support.

In another embodiment a roller rack assembly is disclosed for storing and displaying one or more products. In this embodiment, the roller rack assembly includes a support tray and a roller track assembly disposed on the support tray. The roller track assembly includes at least two roller tracks with each roller track having a front end, a rear end, a bottom and two spaced apart side walls. The roller track includes a base track and a roller frame slidably mounted within the base track. A plurality of rollers are mounted to each roller track and arranged parallel to one another. Each roller has a substantially cylindrical roller surface with a rotational axis, and lateral sides perpendicular to the rotational axis. Each roller also has an axle extending out of each lateral side with an axis coincident with the rotational axis. The roller frame includes two spaced apart frame walls. Each frame wall has a plurality of equally spaced apart holes formed in the frame wall. One of the axles of each roller is located in one of the holes in one of the frame walls and the other axle of each roller is located in one of the holes in the other of the frame walls. The holes are configured to permit the roller to rotate within the holes.

A front end cap is attached to the front end of the roller tracks, and a rear end cap attached to the rear end of the roller tracks. A pusher mechanism is provided and includes a pusher back located above the roller tracks and a pusher foot attached to the pusher back and extending downward into and adapted to slide within a groove located between the two roller tracks. A spring mechanism is provided for biasing the pusher back toward the front ends of the roller tracks for urging products in front of the pusher back to slide on the rollers toward the front ends of the roller tracks. The spring mechanism has a first end secured to the front end cap and a second end mounted to the pusher back or the pusher foot. The front end of each roller track is attached to the front end cap and the rear end of each roller track is attached to the rear end cap.

The foregoing and other features of the invention and advantages of the present invention will become more apparent in light of the following detailed description of the preferred embodiments, as illustrated in the accompanying figures. As will be realized, the invention is capable of modifications in various respects, all without departing from the invention. Accordingly, the drawings and the description are to be regarded as illustrative in nature, and not as restrictive.

BRIEF DESCRIPTION OF THE DRAWINGS

For the purpose of the illustrating the invention, the drawings show a form of the invention which is presently preferred. However, it should be understood that this invention is not limited to the precise arrangements and instrumentalities shown in the drawings.

DETAILED DESCRIPTION OF PREFERRED EMBODIMENTS

Figure 1:
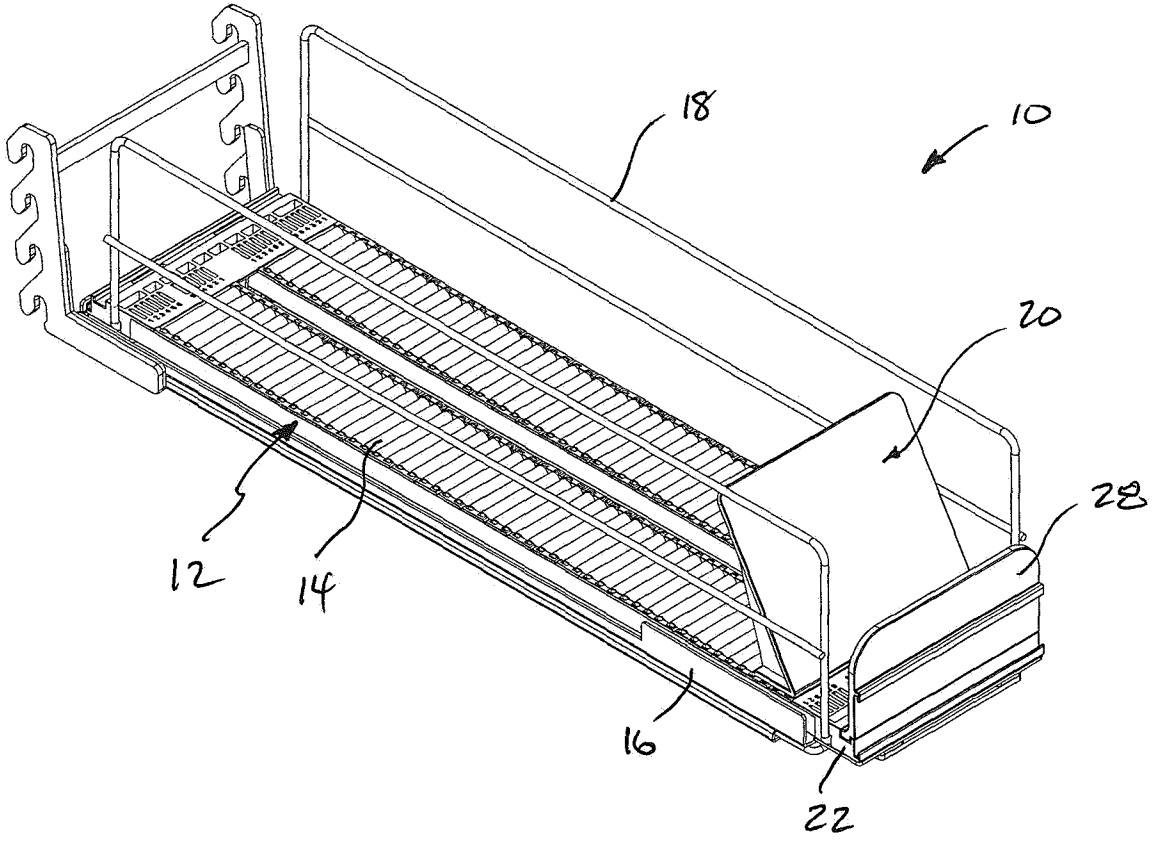
FIG. 1 is a perspective view of a roller shelf assembly according to an embodiment of the invention.

Referring to the figures where preferred embodiments are illustrated, a roller rack assembly 10 is shown in FIG. 1 according to an embodiment of the invention. The assembly is usable in displays in stores or other facilities for storing and displaying one or more products. In the illustrated embodiment, the rack assembly 10 includes a plurality of hooks mounted on the back for securing the rack assembly 10 to a support. However, it is contemplated that other conventional support mechanisms can be used, such as an existing shelf or any other standard display method.

Figure 2:
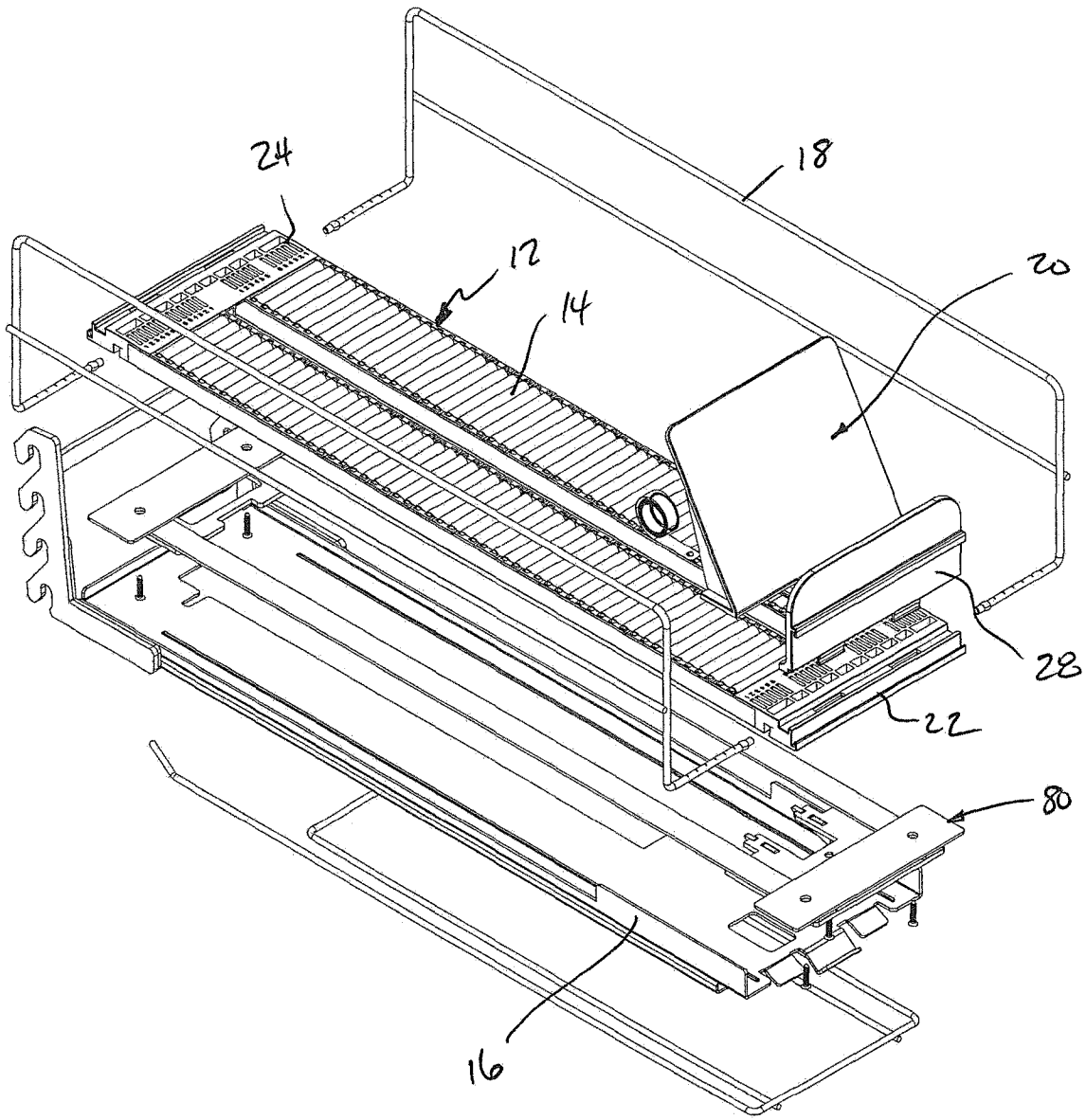
FIG. 2 is an exploded perspective view of the roller shelf assembly of FIG. 1.

The rack assembly 10 includes a roller track assembly 12 that has a plurality of rollers 14 mounted thereon as will be discussed in more detail below. The roller track assembly is mounted to a support tray 16. The rollers 14 are arranged to convey products situated thereon toward the front of the rack assembly. One or more lateral supports 18 are slidably attached to the roller track assembly 12 or tray 16 and configured to translate laterally relative to the roller track assembly 12. A pusher mechanism 20 includes a spring mechanism for urging or biasing the pusher mechanism 20 toward the front of the assembly 10. This urges products in front of the pusher assembly to slide on the rollers 14 toward the front of the assembly 10. FIG. 2 illustrates an exploded view of the assembly 10.

Figure 3:
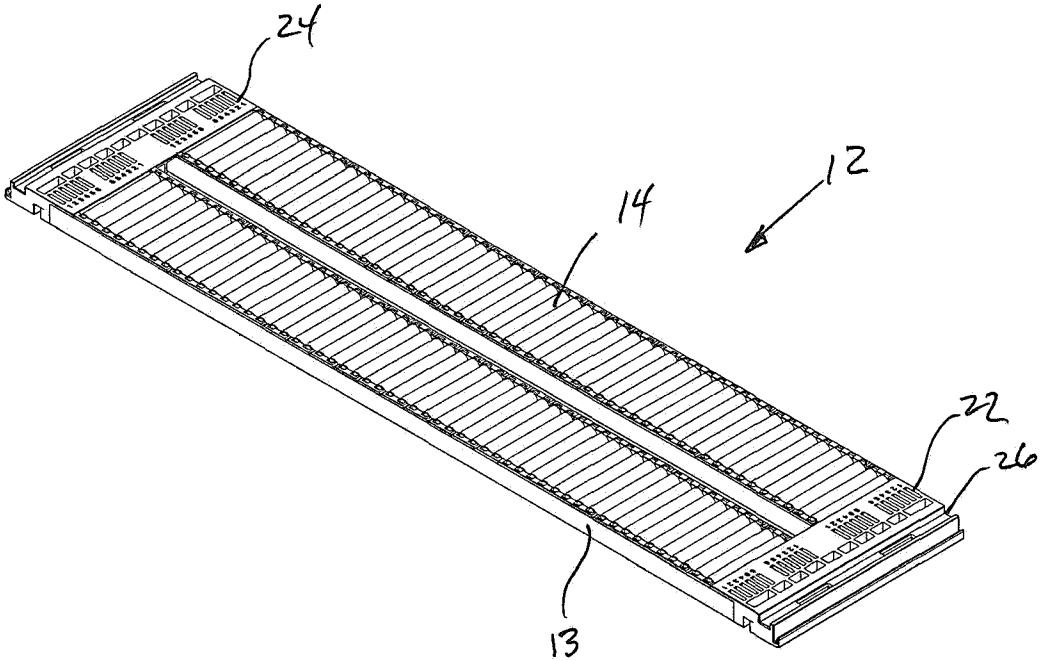
FIG. 3 is a perspective view of a roller track assembly for incorporation into the roller rack assembly of FIG. 1.
Figure 4:
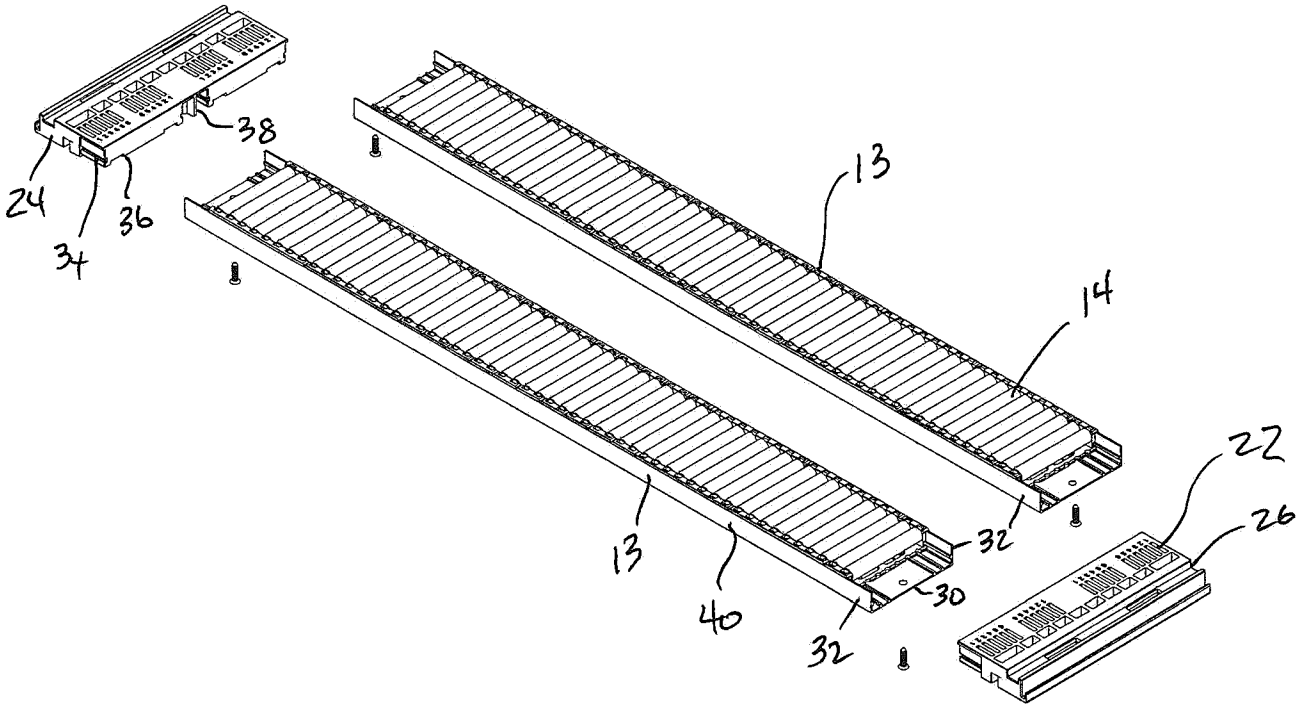
FIGS. 4 and 5 are an exploded perspective view of the roller track assembly of FIG. 3.

Referring to FIGS. 3 and 4, one embodiment of the roller track assembly 12 is shown. The roller track assembly 12 includes two roller tracks 13 each with a plurality of rollers 14. It should be readily apparent that the roller track assembly 12 may include one or multiple roller tracks 13. The rollers 14 in each roller track 13 are arranged parallel to one another to facilitate product displacement toward the front end of the roller track assembly 12. The roller track assembly 12 includes a front end cap 22 and a rear end cap 24, The end caps are preferably identical, but that is not necessary in the invention. The front end cap 22 includes a slot 26 that extends substantially across the end cap preferably parallel to the rollers. The slot 26 is located proximate to the end and is designed to receive a display panel 28 (FIG. 1) which stops or inhibits forward motion of products that are on the rollers. The display panel 28 may include advertisements or other indicia or could be a clear panel. The end caps 22, 24 are secured to ends of each roller track 13. In the illustrated embodiment, each roller track 13 has a U-shaped end defined by a bottom 30 and two opposed side walls 32. Each end cap 22, 24 includes laterally recesses in its sides 34 and base 36, and one or more internal grooves 38. The side walls 32 of each track 13 are designed to side into the one recessed side 34 and the groove 38 with the bottom 30 of the track 13 sliding onto the recess in the base 36 as shown in FIG. 3. Tongue and groove type structures can be incorporated to facilitate assemble and securing.

Figures 5, 5A:
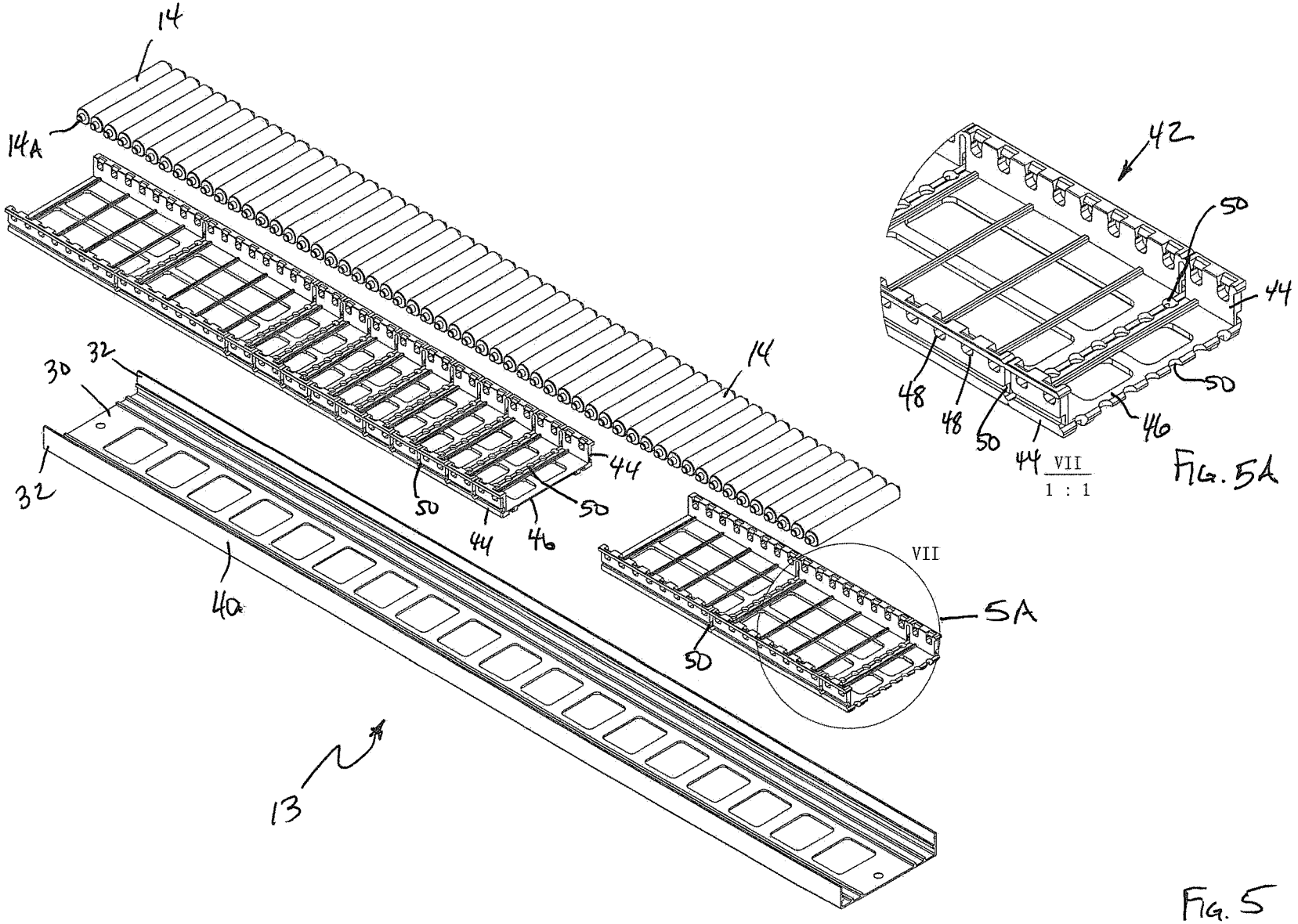
FIG. 5A is an enlarged view of a portion of a roller frame of FIG. 3.

Referring to FIG. 5, an exploded view of the roller track 13 according to one embodiment of the invention is shown. The roller track 13 includes a base track 40 onto which a roller frame 42 is slidably mounted. As discussed above the base track is U-shaped and includes the side walls 32 and bottom 30. Likewise the roller frame 42 is U-shaped with two side frame walls 44 and a frame base 46. The roller frame 42 is sized to fit between the side walls 32 of the base track 40 and rest on the bottom 30.

Figure 6:
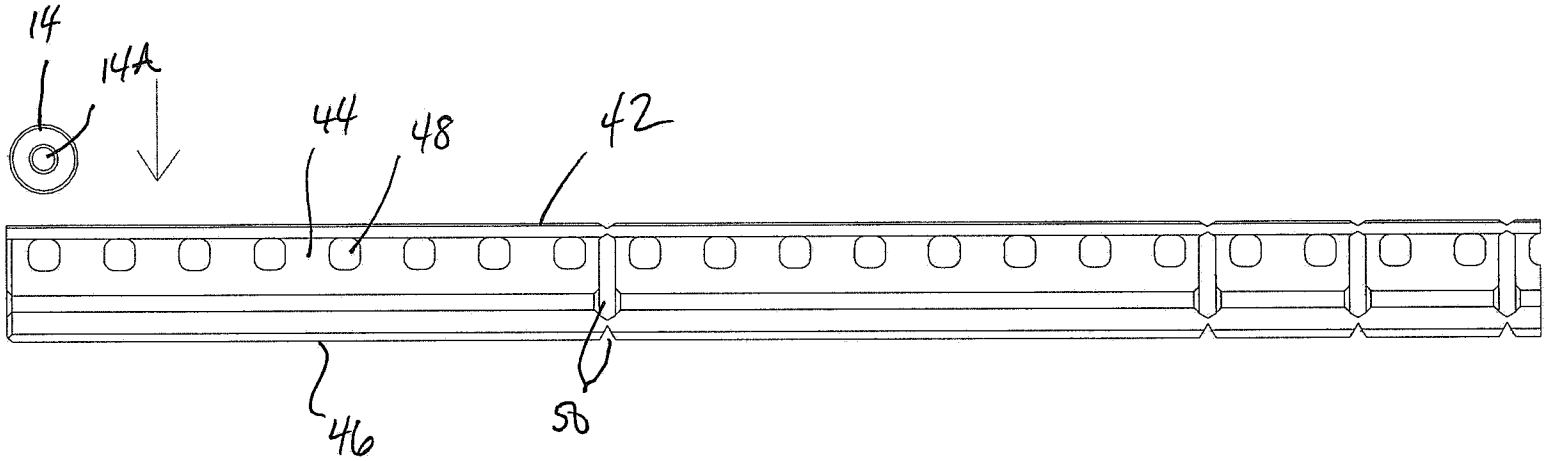
FIG. 6 is a side view of the roller frame of FIG. 3.

The roller frame 42 includes a plurality of preferably equally spaced apart holes 48 formed in the frame walls 44. Each roller 14 has an axle hub 14A extending out of opposite sides of the roller 14. Each axle hub is configured to fit within a hole 48 in the frame walls 44. The holes 48 on opposite frame walls 44 are aligned so as to mount the rollers 14 between the frame walls 44 and permit the rollers 14 to rotate within the holes 48. Referring to FIG. 6, to insert the rollers 14 in the roller frame 42, the frame walls 44 are designed to flex laterally. Thus, during assembly, the roller 14 is pressed downward on the roller frame 42. The downward force of the axle hubs 14A cause the frame walls 44 to bend laterally allowing the axle hubs 14A to snap into the holes 48 as the frame walls 44 flex back.

The roller frame 42 is preferably formed with break points 50 at different locations. The break points 50 may be lines of weakening (such as notches, cuts, holes or perforations) formed in the frame walls and frame base 46 at discrete locations. These break points permit the roller frame 42 to be broken into small frame components as shown in FIG. 5. This allows the roller frame 42 to be configured to any desired length. It is also contemplated that the frame could be extruded to permit forming the roller frame 42 in varying lengths.

Figure 7:
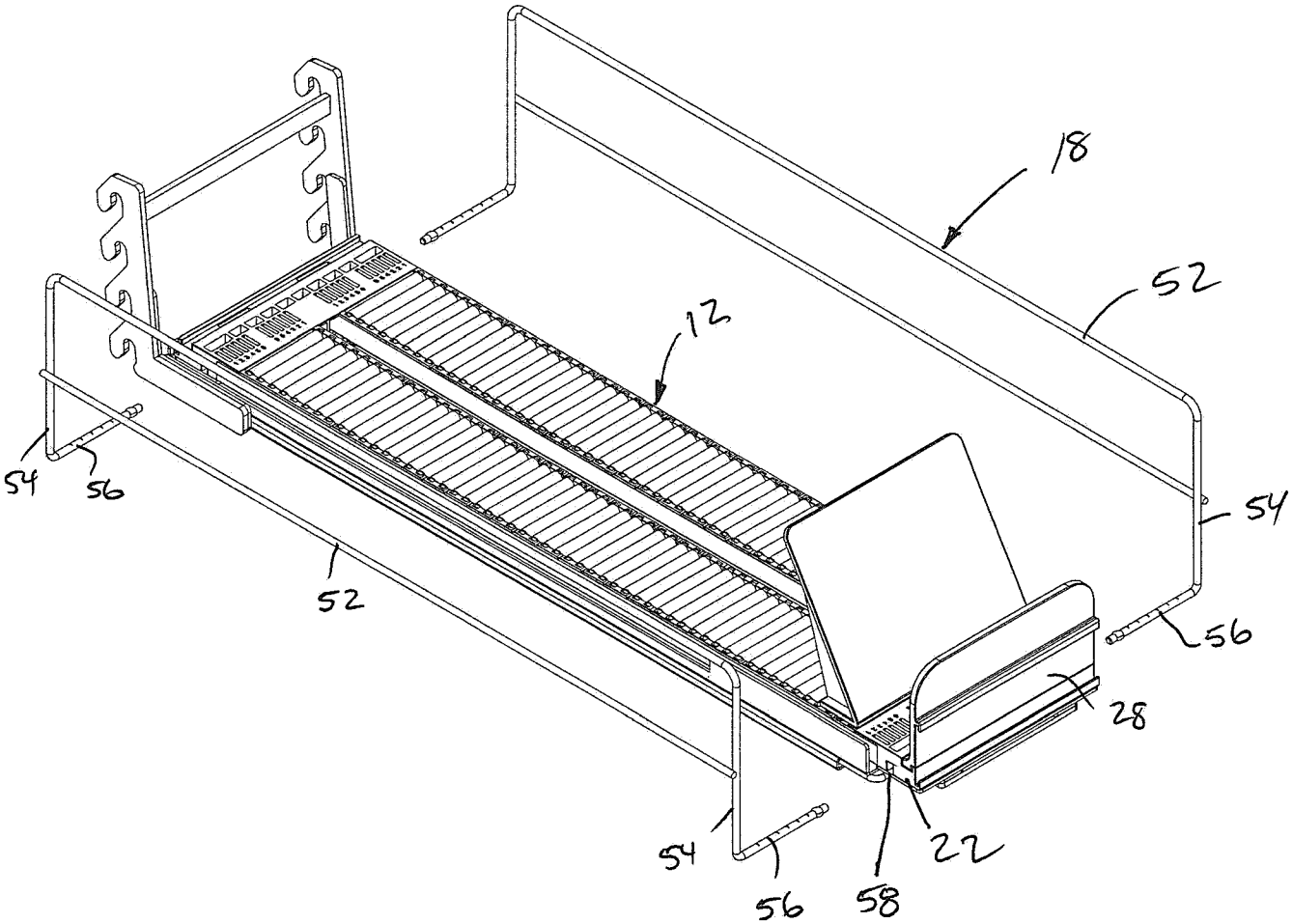
FIG. 7 is a perspective view of the roller rack assembly of FIG. 1 illustrating the attachment of the side rails.

Referring to FIG. 7, the lateral supports 18 are shown separated from the assembly 10. The lateral supports 18 include a longitudinal rail 52 supported on its front and rear ends by vertical rails 54. Each vertical rail 54 includes a foot 56 that is sized to fit within a hole or groove 58 formed in the sides of the end cap 22, 24. The feet 56 are designed to slide within the hole or groove 58, thus permitting the user to change to width of the lateral supports depending on the product size.

Figure 8:
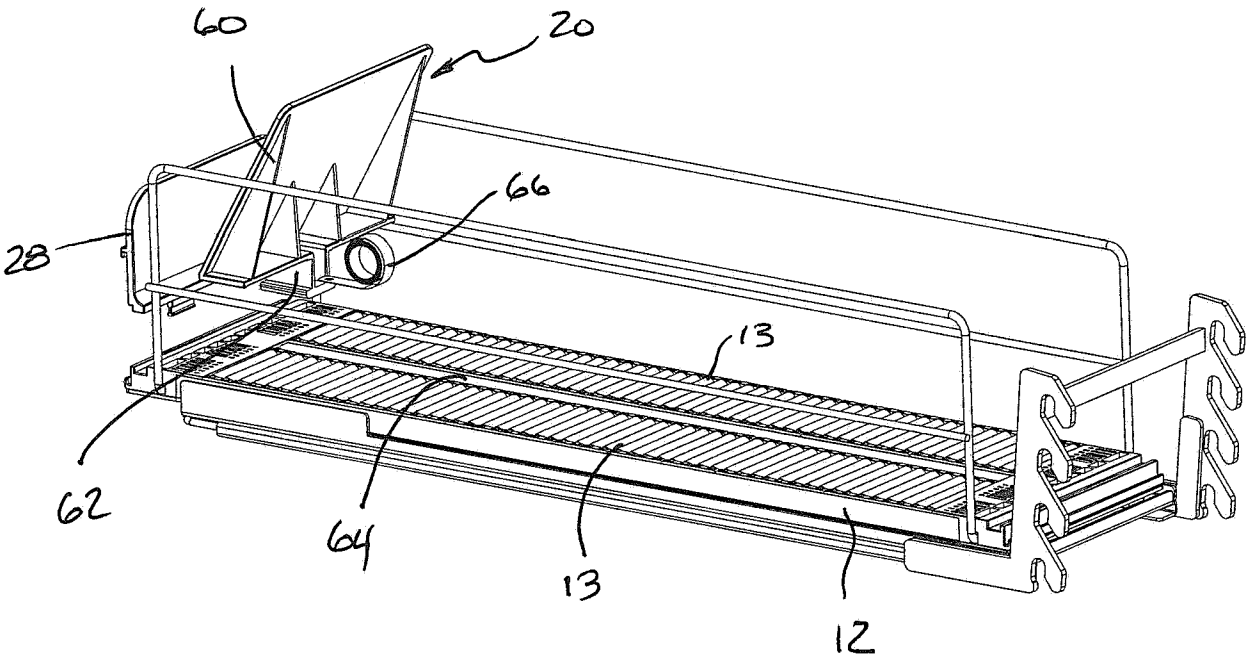
FIG. 8 is rear perspective view illustrating some of the features of a pusher mechanism for use in the present invention.

FIG. 8 illustrates the rear side of the pusher mechanism 20. The pusher mechanism 20 includes a pusher back 60 which is configured to push the back of the last product sitting on the rollers. The pusher back 60 includes a pusher foot 62 that is sized to slide within a groove 64 in the roller track assembly 12. In the illustrated embodiment, the groove is located between adjacent roller tracks 13. A spring 66, such as a torsion spring, bias the pusher back 60 toward the front of the assembly 10. In one embodiment an end of the spring 66 is secured to the front of the assembly 10, preferably to the bottom of the end cap 22 and the other end of the spring is mounted to the pusher back 60 or the pusher foot 62. As the pusher back 60 is slid rearward, the spring 60 develops potential energy (either by stretching or uncoiling). The products on the roller track assembly 12 between the display panel 28 and the pusher back 60 maintain the pusher back 60 spaced apart from the display panel 28. As products are removed, the potential energy of the spring 66 urges the pusher back forward towards the display panel 28.

Figure 9:
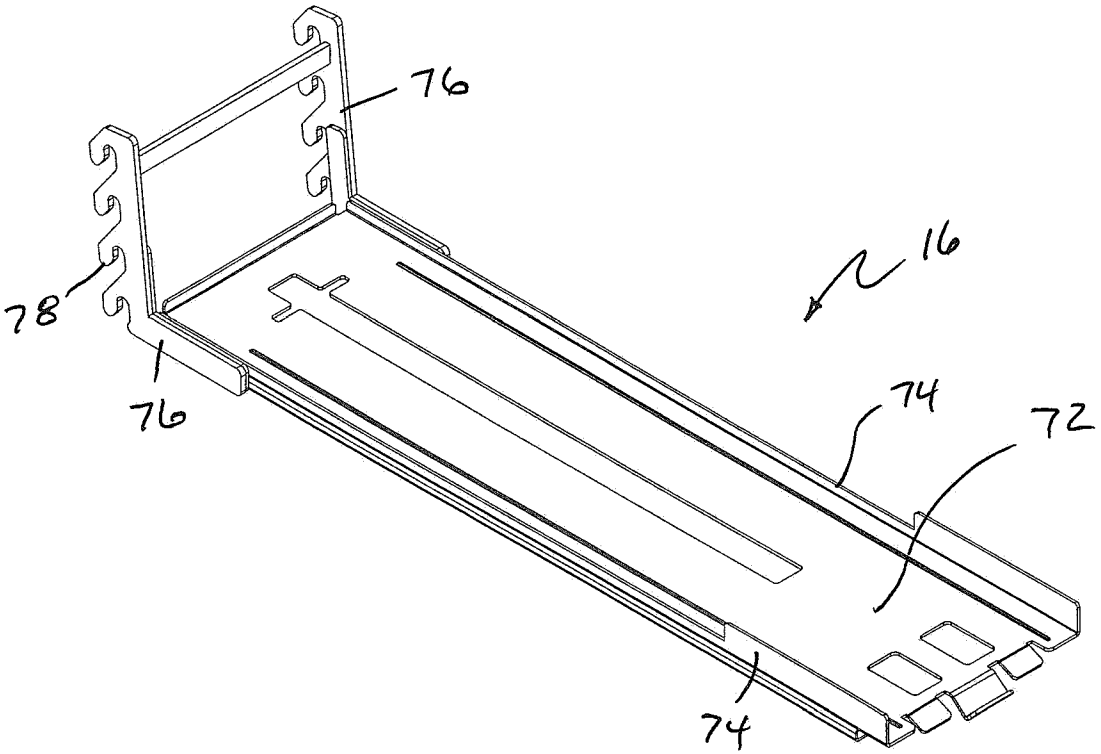
FIG. 9 illustrates a support tray that is used in one embodiment of the roller rack assembly of FIG. 1.

FIG. 9 illustrates the tray 16 for supporting the roller track assembly 12 in a display. In this embodiment, the tray 16 includes a bottom 72 and two spaced apart tray sides 74. The tray 16 is U-shaped and designed to receive the roller track assembly 12. The tray 16 includes two vertical brackets 76 that include hooks 78 designed to engage mounting slots in the display, or on a grid or shelf.

Figure 10:
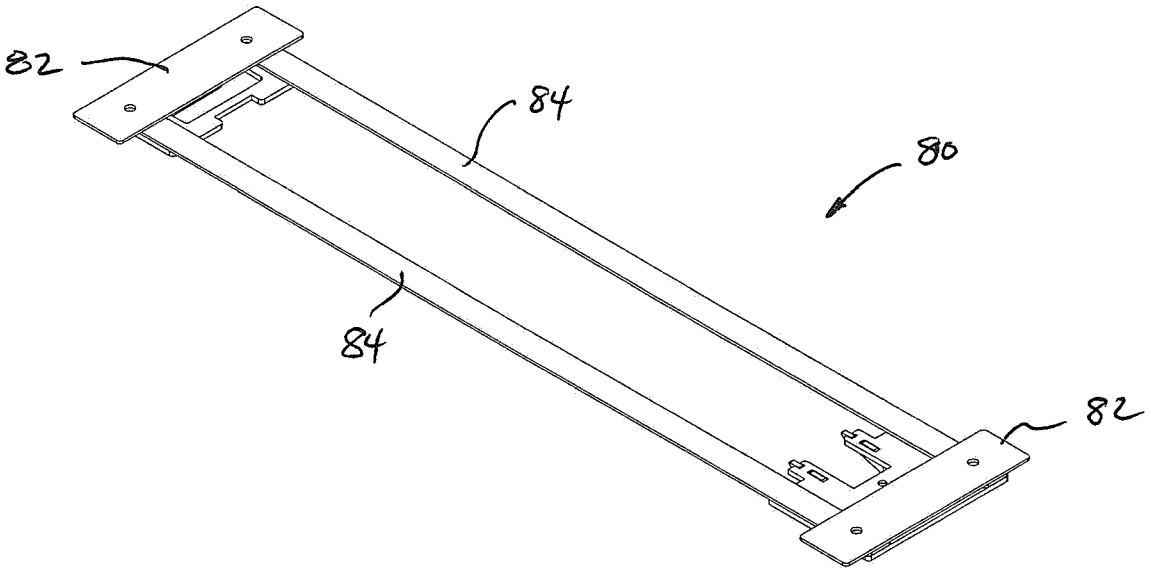
FIG. 10 illustrates optional support frame for use in the roller rack assembly of FIG. 1.

FIG. 10 illustrates an optional support frame 80 that attaches to the bottom of the roller track assembly 12. The support frame 80 includes brackets 82 that attach to the bottom of the end caps 22, 24 and longitudinal beams 84 that are attached to the brackets for providing support.

It is contemplated that portions of the roller assembly could be designed to telescope. For example, the support frame 80 could be configured to slide on or with respect to the tray 16, thereby facilitating loading and unloading.

As used herein, the term "engage" is intended to both direct physical engagement through one or more components as well as operative engagement.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed. The various embodiments and elements can be interchanged or combined in any suitable manner as necessary.

The use of directions, such as forward, rearward, top and bottom, upper and lower are with reference to the embodiments shown in the drawings and, thus, should not be taken as restrictive. Reversing or flipping the embodiments in the drawings would, of course, result in consistent reversal or flipping of the terminology.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalent.

The invention claimed is:

1. A roller rack assembly for storing and displaying one or more products, the roller rack assembly comprising:

a support tray;

a roller track assembly disposed on the support tray, the roller track assembly including:

at least one roller track with a front end, a rear end, a bottom and two spaced apart side walls, a front end cap attached to the front end of the roller track;

a rear end cap attached to the rear end of the roller track; and a plurality of rollers mounted to the roller track and arranged parallel to one another, each roller having a substantially cylindrical roller surface with a rotational axis, and lateral sides perpendicular to the rotational axis, each roller having an axle extending out of each lateral side with an axis coincident with the rotational axis, and each axle rotationally mounted to a side wall of the roller track so that the roller can rotate about its axles; and a pusher mechanism including a pusher back located above the roller track and a spring mechanism biasing the pusher back toward the front end of the roller track for urging products in front of the pusher back to slide on the rollers toward the front end of the roller track;

wherein the bottom and side walls of the roller track define a U-shape and wherein the front end cap and rear end cap each include laterally spaced apart sides and a base that are shaped to engage with the sides and the bottom of the roller track so that the front and rear end caps are each captured within and secured to the roller track.

2. The roller rack assembly of claim 1, wherein the front end cap includes a slot that extends substantially across the end cap, the slot configured to receive a display panel which stops or inhibits forward motion of products that are on the rollers.

3. The roller rack assembly of claim 1, further comprising a plurality of hooks mounted on the back of the support tray for securing the support tray to a structure.

4. The roller rack assembly of claim 1, further comprising one or more lateral supports slidably attached to the roller track assembly or the support tray and configured to be laterally translatable relative to the roller track assembly.

5. The roller rack assembly of claim 1, wherein the roller track assembly includes at least two roller tracks.

6. The roller rack assembly of claim 5, wherein the pusher back includes a pusher foot that is sized to slide within a groove in the roller track assembly located between the two roller tracks.

7. The roller rack assembly of claim 1, wherein the spring mechanism includes a torsion spring with a first end secured to the front end cap and a second end mounted to the pusher back or a pusher foot.

8. The roller rack assembly of claim 1, wherein the roller track includes a base track and a roller frame, and wherein the roller frame is slidably mounted within the base track.

9. The roller rack assembly of claim 8, wherein the roller frame includes two spaced apart frame walls, each frame wall having a plurality of equally spaced apart holes formed in the frame wall, and wherein one of the axles of each roller is located in one of the holes in one of the frame walls and the other axle of the roller is located in one of the holes in the other of the frame walls, the holes configured to permit the roller to rotate within the holes.

10. The roller rack assembly of claim 8, wherein the roller frame is formed with weakened points along its length, the weakened points facilitating the breaking of the roller frame at the locations of the weakened points.

11. The roller rack assembly of claim 1, further comprising a support frame attached to the bottom of the roller track assembly, the support frame includes brackets that attach to the bottom of the front end cap and rear end cap and longitudinal beams that are attached to the brackets for providing support.

12. A roller rack assembly for storing and displaying one or more products, the roller rack assembly comprising:

a support tray;

a roller track assembly disposed on the support tray, the roller track assembly including:

at least two roller tracks, each roller track having a front end, a rear end, a bottom and two spaced apart side walls, each roller track including a base track and a roller frame slidably mounted within the base track;

a plurality of rollers mounted to each roller track and arranged parallel to one another, each roller having a substantially cylindrical roller surface with a rotational axis, and lateral sides perpendicular to the rotational axis, each roller having an axle extending out of each lateral side with an axis coincident with the rotational axis;

wherein each roller frame includes two spaced apart frame walls, each frame wall having a plurality of equally spaced apart holes formed in the frame wall, and wherein one of the axles of each roller is located in one of the holes in one of the frame walls and the other axle of each roller is located in one of the holes in the other of the frame walls, the holes configured to permit the roller to rotate within the holes;

a front end cap attached to the front end of the roller tracks;

a rear end cap attached to the rear end of the roller tracks; and a pusher mechanism including:

a pusher back located above the roller tracks and a pusher foot attached to the pusher back and extending downward into and adapted to slide within a groove located between the two roller tracks; and a spring mechanism for biasing the pusher back toward the front ends of the roller tracks for urging products in front of the pusher back to slide on the rollers toward the front ends of the roller tracks, the spring mechanism having a first end secured to the front end cap and a second end mounted to the pusher back or the pusher foot; and wherein the front end of each roller track is attached to the front end cap and the rear end of each roller track is attached to the rear end cap.

13. The roller rack assembly of claim 12, wherein the front end cap includes a slot that extends substantially across the end cap, the slot configured to receive a display panel which stops or inhibits forward motion of products that are on the rollers.

14. The roller rack assembly of claim 13, further comprising a plurality of hooks mounted on the back of the support tray for securing the support tray to a structure.

15. The roller rack assembly of claim 12, further comprising one or more lateral supports slidably attached to the roller track assembly or the support tray and configured to be laterally translatable relative to the roller track assembly.

16. The roller rack assembly of claim 12, wherein the spring mechanism includes a torsion spring with a first end secured to the front end cap and a second end mounted to the pusher back or the pusher foot.

17. The roller rack assembly of claim 12, wherein the bottom and side walls of the roller track define a U-shape and wherein the front end cap and rear end cap each include laterally spaced apart sides and a base that are shaped to engage with the sides and the bottom of the roller track so that the front and rear end caps are each captured within and secured to the roller track.

18. The roller rack assembly of claim 12, wherein the roller frame is formed with weakened points along its length, the weakened points facilitating the breaking of the roller frame at the locations of the weakened points.

19. The roller rack assembly of claim 12, further comprising a support frame attached to the bottom of the roller track assembly, the support frame includes brackets that attach to the bottom of the front and rear end caps and longitudinal beams that are attached to the brackets for providing support.

* * * * *